US005344216A

United States Patent [19]

Suominen

[11] Patent Number: 5,344,216

[45] Date of Patent: Sep. 6, 1994

[54] SOFA OR ARMCHAIR WITH ADJUSTABLE SITTING DEPTH

[76] Inventor: Kersti H. Suominen, Paulinkatu 35, SF-304200 Forssa, Finland

[21] Appl. No.: 923,798

[22] PCT Filed: Mar. 6, 1991

[86] PCT No.: PCT/FI91/00064

§ 371 Date: Sep. 3, 1992

§ 102(e) Date: Sep. 3, 1992

[87] PCT Pub. No.: WO91/13574

PCT Pub. Date: Sep. 19, 1991

[30] Foreign Application Priority Data

Mar. 9, 1990 [FI] Finland ..... 901193

[51] Int. Cl.[5] ..... B60N 2/02

[52] U.S. Cl. ..... 297/383; 297/353

[58] Field of Search ..... 297/383, 353; 5/59.1, 5/47, 48, 18.1

[56] References Cited

U.S. PATENT DOCUMENTS

| | | | |
|---|---|---|---|
| 2,645,788 | 7/1953 | Knoll et al. | 297/383 X |
| 3,855,646 | 12/1974 | Glickman | 297/383 X |
| 4,447,920 | 5/1984 | Rosen | 297/383 X |
| 4,570,998 | 2/1986 | Hughes | 297/353 |
| 4,728,150 | 3/1988 | Gaudreau, Jr. . | |
| 4,763,952 | 8/1988 | Gaudreau, Jr. | 297/383 |
| 5,038,422 | 8/1991 | Messina | 5/51.1 X |
| 5,067,187 | 11/1991 | Messina | 297/383 X |

FOREIGN PATENT DOCUMENTS

| | | | |
|---|---|---|---|
| WO88/01841 | 3/1988 | PCT Int'l Appl. . | |
| 119697 | 9/1947 | Sweden . | |
| 2757/56 | 1/1962 | Sweden . | |
| 354411 | 3/1973 | Sweden . | |
| 0260665 | 11/1926 | United Kingdom | 297/383 |

*Primary Examiner*—Kenneth J. Dorner
*Assistant Examiner*—Milton Nelson, Jr.
*Attorney, Agent, or Firm*—Larson and Taylor

[57] ABSTRACT

A sofa or armchair with adjustable sitting depth (7-8), which has a back rest (1), which can be detached and taken off and the distance of which can be changed and thus, the sitting depth can be changed, and to which belongs an adjusting and locking device (2), with which a stepless or adjustment with steps are locked. E.g. the back of a sofa is traditionally fixed and almost all adjustment possibilities have been different solutions by cushions, which however, are not always satisfying when thinking of needs of different people. With this solution people of different lengths can adjust the sitting depth of a sofa or armchair fitting to themselves, which at the same time makes the sitting more comfortable and along with that reduces likelihood of back problems. Also the adjustable back rest gives new dimensions and possibilities for furniture design and product development.

9 Claims, 2 Drawing Sheets

SOFA OR ARMCHAIR WITH ADJUSTABLE SITTING DEPTH

FIELD OF THE INVENTION

The invention relates to a sofa or armchair with an adjustable backrest to accommodate people of differing height.

DESCRIPTION OF THE INVENTION

Various types of backrests are known, including:

A. fixed back rest;

B. the following methods or mechanisms: inclination of the back rest, support for the lumbar region of the back, moving of back high position, and lifting and inclining of the seat;

C. car seats and the like are fitted with equipment to move the whole seat such as glide rails or the like;

D. office chairs can also have distance adjustment of the support for the lumbar region of the back.

The known systems and methods for distance regulation of the back, mainly used in chairs, are not designed for use in couches, sofas and armchairs and are therefore impossible or at least only with difficulty applicable to sofas or armchairs. Furthermore, these systems are too complicated and troublesome to be used by children and the elderly. To unfasten, to take off and remount the back of a sofa would be difficult or impossible.

SUMMARY OF THE INVENTION

An armchair or sofa with an adjustable sitting depth in accordance with the invention has a simple construction and is easy to use. The back is easy to take off and to place back, and the sitting depth adjustment is simple to effect.

After disconnecting the back it can be taken off and placed back simply, and then easily locked by moving the adjustment locking device into locking position.

The invention makes it possible for people of different height to adjust the back rest of their sofa to a position where the backrest gives the best support to the back and keeps the sitting position comfortable, thus reducing for its part various back problems which result from a bad sitting position.

The invention provides a new point of view for furniture design and makes it possible to design a piece of furniture which is both practical and versatile.

DESCRIPTION OF PREFERRED EMBODIMENTS

Figure 1:
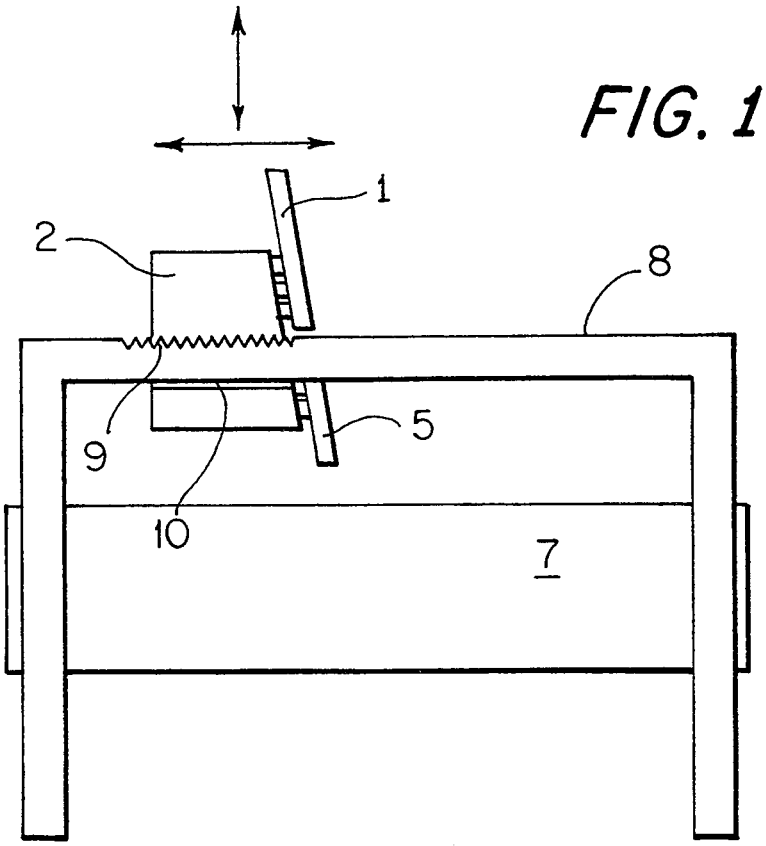
FIG. 1 is a diagrammatic side elevation view of a first embodiment of a sofa or armchair in accordance with the invention with an adjustable sitting depth with a back rest and an adjusting and locking service.
Figure 1A:
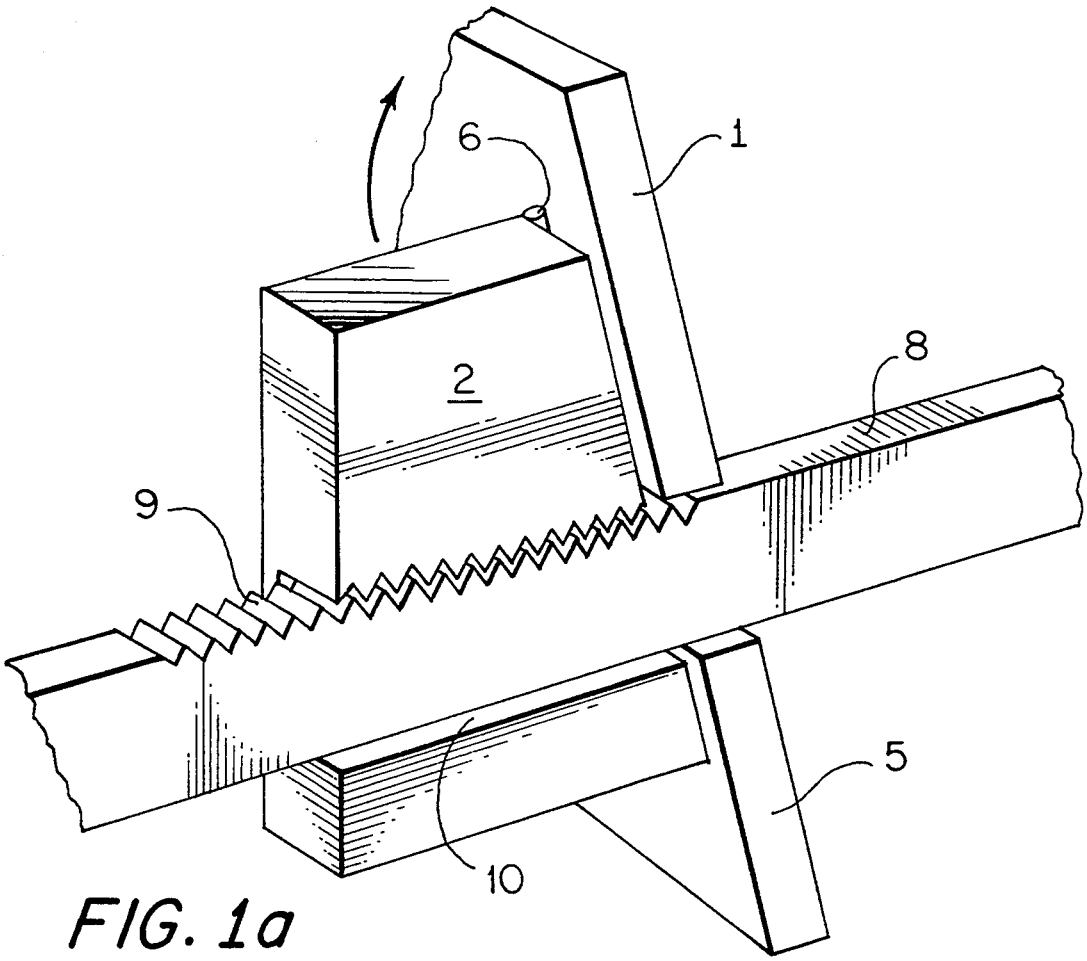

FIG. 1 shows the end of a sofa or armchair—seen from the side—where 7 is the sofa or armchair, 8 the end comprising of a lifting or armrest part, 1 the back rest, with an adjusting and locking device 2 in its locking position. When adjustment of the position of the backrest is to be effected in predetermined steps, surfaces of locking device 2 and corresponding surfaces of armrests 8 can be roughened at locations 9 and/or 10 or provided at locations 9 and/or 10 with cogs, slots, pins or the like in order to increase the locking effect of locking device 2. In the illustrated embodiment, cogs are provided on the upper surface of armrest 8 and on the corresponding upper surface of slot 3 in device 2.

Figure 2:
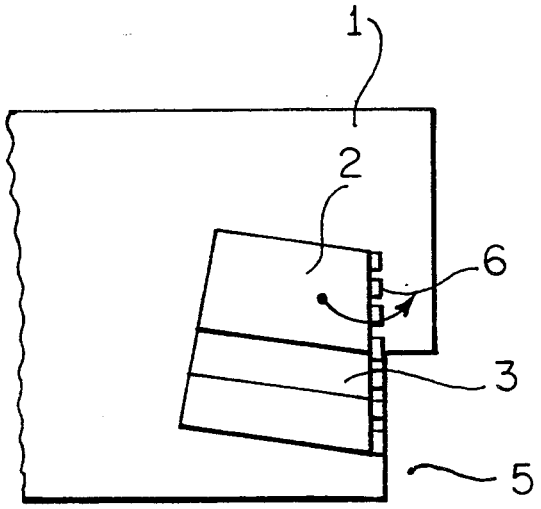
FIG. 2 is a diagrammatic rear elevation view of a portion of the embodiment of FIG. 1 showing an end of the back rest—seen from behind—and its adjusting and locking device here turned to the left.

FIG. 2 shows the back rest 1 from behind. The adjustable and locking device 2 is fastened to the back with a hinge 6. The device 2 has a locking slot 3, which locks the adjustment when the device is turned on hinge 6 to its locking position. No. 5 points out the place where there is a slot on the back rest which makes it possible to place the back directly down onto the armrests or to lift it up and remove the whole back from the armrests.

Figure 3:
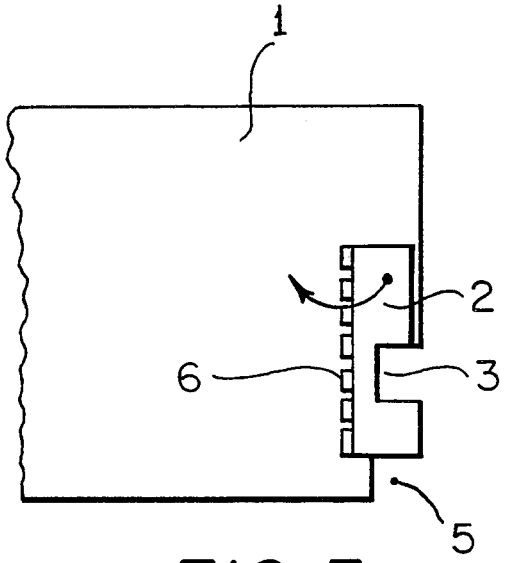
FIG. 3 is like FIG. 2 but the adjusting and locking device is turned to its locking position as shown in FIG. 1.

FIG. 3 is the same as FIG. 2 but the adjusting and locking device 2 is shown turned on hinge 6 to the right to its locking position, with the locking slot being clearly visible.

Figure 4:
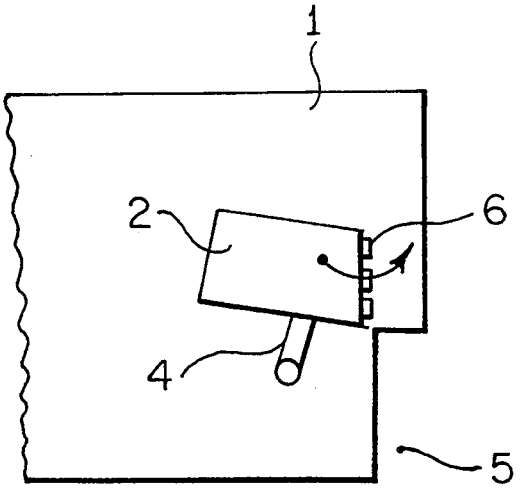
FIGS. 4 and 5 are like FIGS. 2 and 3 and illustrate a second embodiment of an adjusting and locking device in accordance with the invention.
Figure 5:
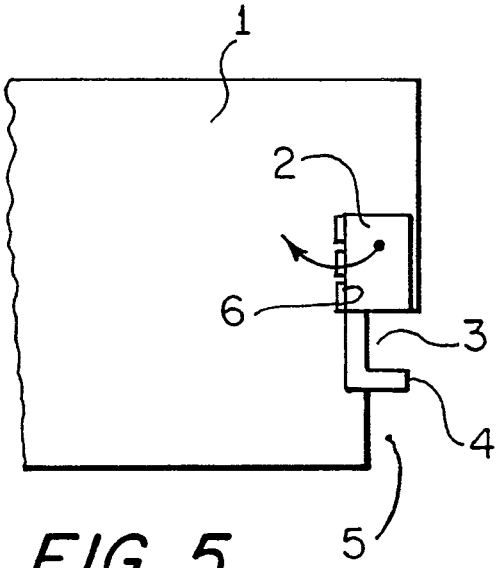

In the embodiment of FIGS. 4 and 5 the back rest 1 is of the same kind as in FIGS. 1–3, but the adjusting and locking device 2 is smaller and the slot is replaced by a locking bolt or hook 4, or by a corresponding holder.

In lieu of the hinge mounting illustrated in FIGS. 1–5, the adjusting and locking device may be slidably mounted on backrest 1 such as on a rail or in a slot on the backrest.

Figure 6:
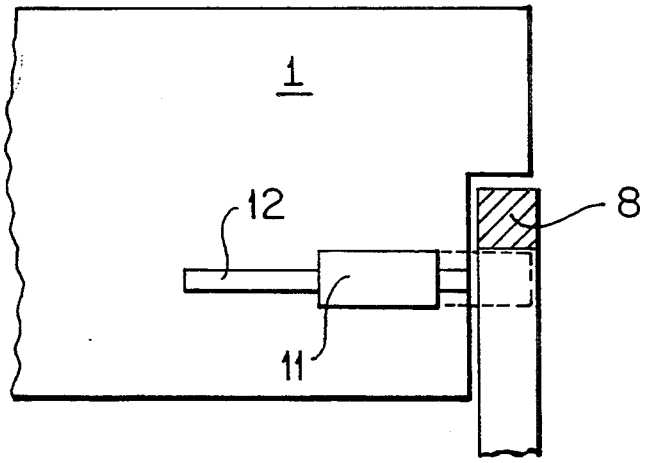
FIG. 6 is a diagrammatic rear elevation view of a portion of a sofa or armchair illustrating a third embodiment of an adjusting and locking device in accordance with the invention.

A suitable arrangement is shown in FIG. 6 in which the adjustable locking device comprises a pin 11 which is movable along slot 12 in backrest 1 between a locking position shown in phantom in which pin 11 engages armrest 8, and disengaged position shown in full line in which pin 11 is disengaged from armrest 8. A suitable arrangement is shown in FIG. 6 in which the adjustable locking device comprises a pin 11 which is movable along slot 12 in backrest 1 between a locking position shown in phantom in which pin 11 engages armrest 8 and a disengaged position shown in full line in which pin 11 is disengaged from armrest 8.

What is claimed is:

1. In a sofa or armchair having armrests and a backrest, the improvement which comprises:

a movable and adjustable locking device mounted on each end of the backrest for adjusting the sitting depth of the backrest horizontally to accommodate people of differing height; and means for mounting each of said adjustable locking devices on said backrest such that each adjustable locking is movable between a locking position in which said device engages said armrest such that said backrest is secured in a desired sitting depth position and such that said backrest is prevented from being lifted off of said armrests, and a disengaged position in which said locking device is disengaged from said armrest such that, when both of said adjustable locking devices are in said disengaged position, said backrest can be moved horizontally along said armrests to adjust said sitting depth of the backrest, and can be lifted off of or placed down on said armrests;

each of said adjustable locking devices, after being moved into said locking position to locate said backrest in said desired sitting depth position, engaging said armrest for locking the backrest in said desired sitting depth position.

2. A sofa or armchair according to claim 1 wherein said mounting means comprises a hinge connecting the adjustable locking device to said backrest whereby said adjustable locking device is turnable on said hinge between said locking and disengaged positions.

3. A sofa or armchair according to claim 1 wherein said locking device comprises a member slidably mounted on said backrest for movement between said locking position and said disengaged position.

4. A sofa or armchair according to claim 1 wherein said armrest comprises means for increasing the locking effect of said adjustable locking device for locking the backrest in said desired sitting depth position.

5. A sofa or armchair according to claim 4 wherein said locking effect increasing means comprises a form or shape on a surface of said arm rest which is engaged by said adjustable locking device when said adjustable locking device is in said locking position.

6. A sofa or armchair according to claim 4 wherein said adjustable locking device comprises means for increasing its locking effect for locking the backrest in said desired sitting depth position.

7. A sofa or armchair according to claim 6 wherein said locking effect increasing means comprises a form or shape of a surface of said adjustable locking device which engages said armrest when said adjustable locking device is in said locking position.

8. A sofa or armchair according to claim 1 wherein said adjustable locking device comprises means for increasing its locking effect for locking the backrest in said desired sitting depth position.

9. A sofa or armchair according to claim 8 wherein said locking effect increasing means comprises a form or shape of a surface of said adjustable locking device which engages said armrest when said adjustable locking device is in said locking position.

* * * * *